United States Patent [19]

Shimada et al.

[11] 4,126,001

[45] Nov. 21, 1978

[54] METHOD FOR CONSTRUCTING A SOIL STRUCTURE

[75] Inventors: Yoshiharu Shimada; Manao Suzuki, both of Tokyo; Masaru Hoshiya, Hiratsuka, all of Japan

[73] Assignee: Kyokado Engineering Co., Ltd., Tokyo, Japan

[21] Appl. No.: 747,903

[22] Filed: Dec. 6, 1976

[30] Foreign Application Priority Data

Dec. 9, 1975 [JP] Japan ..... 50-145892

[51] Int. Cl.[2] ..... E02D 17/00

[52] U.S. Cl. ..... 405/287; 52/169.1; 405/273; 405/258

[58] Field of Search ..... 61/35, 39, 47, 49, 50; 52/169.1

[56] References Cited

U.S. PATENT DOCUMENTS

| | | | |
|---|---|---|---|
| 2,138,037 | 11/1938 | Lane | 61/39 X |
| 2,917,901 | 12/1959 | Lackner | 61/64 |
| 3,753,354 | 8/1973 | Bauer | 61/39 |
| 3,802,204 | 4/1974 | Mason | 61/39 |
| 3,922,864 | 12/1975 | Hilfiker | 61/35 |
| 3,925,994 | 12/1975 | Broms | 61/39 |
| 4,000,623 | 1/1977 | Meardi | 61/39 |

*Primary Examiner*—Jacob Shapiro
*Attorney, Agent, or Firm*—Martin A. Farber

[57] ABSTRACT

A method for constructing a soil structure comprising a step of disposing reinforcements into a ground to thereby unify the soil structure by the friction force caused between the reinforcements and soil particles, said reinforcements being principally of rigid structure which possess a property of flexibility at the time of at least the disposition of said reinforcements to accommodate the same to any displacements of soil, the friction force being caused between said rigid structures and said soil particles, to thereby unify the soil structure.

10 Claims, 26 Drawing Figures

METHOD FOR CONSTRUCTING A SOIL STRUCTURE

BACKGROUND OF THE INVENTION

The present invention relates to an improved method for constructing a soil structure, and more specifically to constructing a soil structure retaining the reinforcement of soil by means of friction between soil particles and rigid reinforcements disposed in fill-up ground.

In a structure such as sheathing structures, which is subjected to vibrations and impacts due to traffic, deterioration due to ultraviolet rays, and corrosion due to rainwater and subterranean water, concrete or reinforced concrete is preferably used which is durable against deterioration and corrosion, in view of the durability of such a rigid member with a great mechanical strength. However, in case that any rigid structure such as a concrete block or a concrete wall is constructed on a soft ground, uneven sinking in the ground occurs, which immediately leads to destruction of the structure. Otherwise, in recent years, there has been provided a method for reinforcement of soil by frictional forces between soil particles and flexible reinforcements. In this method, two requirements must be simultaneously satisfied, i.e. for the flexible reinforcements to resist a great tension and to cause sufficent frictional forces between the reinforcements and the soil particles. Thus, these reinforcements should be of a strip so as to possibly increase area of frictional contact with soil and should be made of metallic material. This provides corrosive factor to reinforcements, which leads to a defect injuring permanency thereof.

As a result of our research to solve these problems, we arrived at the concept that the problem of permanency can not be solved so far as we stand on a ground employing flexible members as reinforcements and depending on the reinforcements for tensile strength as well as for frictional condition with soil particles. And, we have finally solved the problem of permanency by employing reinforcements with a great rigidity such as a reinforced concrete, and completed this invention on the basis of inversion of the technical thought to what relies on flexibility of the rigid reinforcements to thereby accommodate to any displacements of the ground.

SUMMARY OF THE INVENTION

Therefore, an object of the invention is to provide a method for constructing a soil structure, which can solve the problem of permanency by accommodating rigid reinforcements to any displacement of soil to thereby satisfy both flexibility and permanency based on sufficient tensile strength and sufficient friction with the rigid members.

Another object of the invention is to provide a method for constructing a soil structure in which reinforcements provide rigidity as well as greater resistance against draw-out thereof.

A still another object of the invention is to provide a durability to a soil structure by means of covering reinforcements with hardener injected therethrough to effectively unify the soil structure.

In attaining the objects of the invention, there is provided an improved method for constructing a soil structure, which comprises a step of disposing reinforcements into a ground to thereby reinforce the soil structure by the friction force caused between the reinforcements and soil particles, an improvement wherein the reinforcements are of rigid structure which possess a property of flexibility at the time of at least the disposition of said reinforcements, the friction force being caused between said rigid structures and said soil particles, thereby to reinforced the soil structure.

Other objects and advantages of the invention will be apparent from the following description taken in conjunction with the accompanying drawings.

BRIEF DESCRIPTION OF THE DRAWINGS

FIG. 3(*b*) is a side view of another reinforcement;

DETAILED DESCRIPTION OF THE INVENTION

Solution 1 Embodied by the Invention

The method according to this invention for constructing soil structures basically employs improved reinforcements which are composed of rigid members and flexible tension members connecting the rigid members. Thus the frictional effect between the reinforcements and soil particles depends on the rigid members and the flexibility of the reinforcements does on the flexible tension members.

In such a structure, the flexible tension members are required only for sufficient tensile strength without providing any frictional property thereof, so that the tension members can be of possibly limited sectional area thereof in order to reduce the influence of corrosion, and surfaces of the tension members can be easily sufficiently treated by an anti-corrosive treatment. Accordingly, as the rigid members and the tension members which form a reinforcement take a portake in the friction and the tensile strength respectively, a soil structure can be provided which satisfies both flexibility and permanency.

Figure 1A:
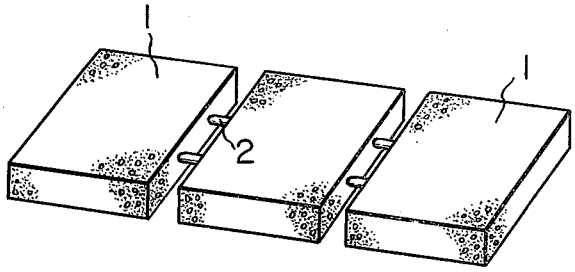
FIG. 1(*a*) is a perspective view of a reinforcement including rigid members and tension members connecting the rigid members, and FIG. 1(*b*) is a section of a modified reinforcement shown in FIG. 1(*a*)
Figure 1B:
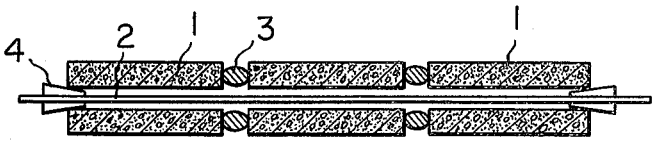

Referring now to FIG. 1, there is exemplified a reinforcement used in the method of the invention. This reinforcement is composed of rigid members 1 and flexible tension members 2 connecting the members 1. As best seen in FIG. 1(*b*), tension members 2 of this type of reinforcement extend through the rigid members and are commonly secured by wedges 4 under pre-tension. A ring 3 is provided for retaining a space between rigid members 1. This pre-tensioned reinforcement enables a soil structure with less displacement under external loads.

Figure 2A:
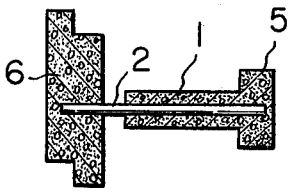
FIG. 2(*a*) is a section of another reinforcement in which a wall block is connected to rigid members through tension members, and FIG. 2(*b*) is a perspective view of the reinforcement shown in FIG. 2(*a*)
Figure 2B:
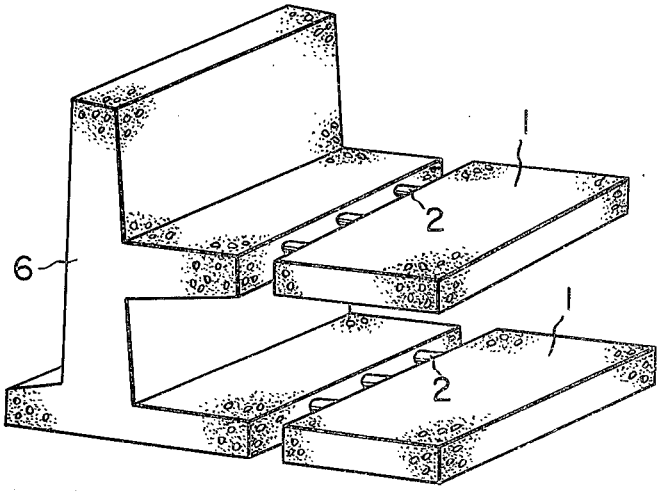
Figure 3A:
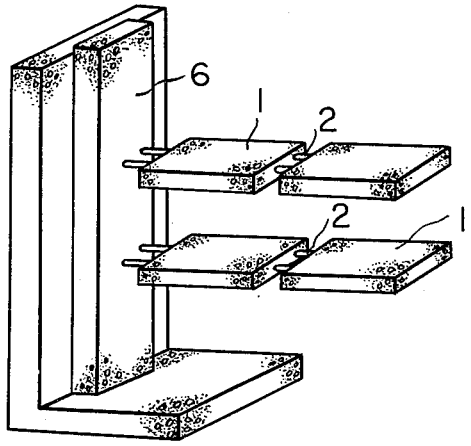
FIG. 3(*a*) is a perspective view of still another reinforcement showing connection between a wall and the reinforcement.
Figure 3B:
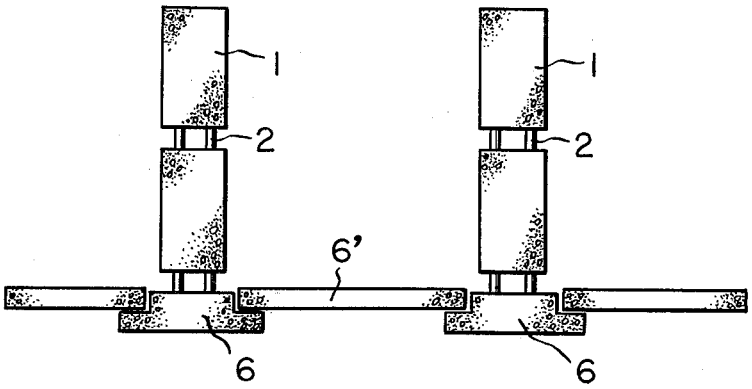

FIGS. 2 and 3 exemplify some sheathing wall structures embodied by this invention, in which a reinforcement is connected to a wall. The wall comprisin block 6 is connected to rigid members 1 through tension members 2. The rigid member 1 shown in FIG. 2(*a*) is provided with an anchor-plate shaped member 5 at an end thereof to increase its drawnout resistance. The wall will be of a retaining wall 6 as shown in FIG. 2(*b*). Reinforcements will be connected to wall columns 6 and concrete panels 6' (FIG. 3*b*) will be disposed at rear sections of the columns. In constructing a sheathing structure by the method of the invention, it is required to connect an end of the reinforcement to the wall surface. In this case, as reinforcements are disposed underground, the more the filling operation is advanced, the greater is the compression of the filled up soil and uneven displacements of base ground develop. If the wall and reinforcements connected thereto were made of any integral rigid members, stress concentration occurs at the connection, which leads to destruction. On the other hand, according to the present invention, since the members used for the connection are flexible members, it is possible to accommodate any displacement.

Solution 2 Embodied by the Invention

This provides another method of the invention to form rigid reinforcements by injecting hardener therethrough to cover the same with the hardener at any time, after the flexible reinforcements with an injecting function were disposed on the ground and filled. Thus this method comprises the steps of (A) setting and filling on the ground, materials of reinforcements having an injecting function therein, made of flexible members; (B) injecting a hardener into said members to harden the members, thereby to dispose the reinforcements of rigid structures into the ground.

In this method, reinforcements are required for flexibility while fill-up soil or base ground is being displaced at filling or after filling, while not for flexibility any longer when no displacements occur. This method of solution is based on this point.

We will now exemplify some of the flexible reinforcements with an injecting function herein described.

(1) Combination of a tension member with an injecting means:

The tension member may be of a type of bar, pipe, frame, strip, wire, clothing, net, sheet, plate, bag, tube formed with any holes and any shaped elements of lattice, jungle-gym or other forms, and made of metal, synthetic resin or these compounds or other materials with flexibility as well as enough tensile strength. As the injecting means, we will employ any type of injection pipe through which material to be injected flows, a tube formed with holes for injection, any type of tubular structure into which an injecting pipe is inserted, and others. As to the combination of the tension members with the injecting means, both can be plased combined in parallel. Otherwise, the one can be inserted in the other.

Figure 4A:
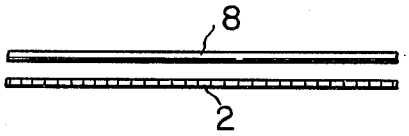
FIG. 4(*a*), (*b*) and (*c*) are respectively a side view, a plan view and a longitudinally sectional view of a reinforcement having an injecting function.
Figure 4B:
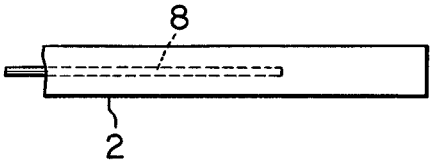
Figure 4C:
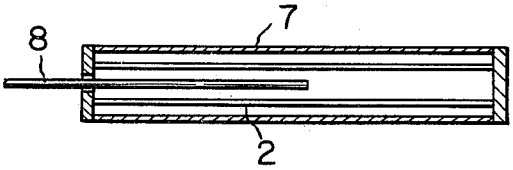

FIG. 4(*a*) shows an example of the reinforcement in which injecting means 8 is put side by side with a tension member 2 of a bar or wire type.

(2) Bar or bag shaped reinforcement having sufficient tensile strength:

This reinforcement may be of a pipe made of metal or synthetic resin with a hole or holes at end or a portion thereof, a net, sheet or cloth shaped pipe made of metal or synthetic resin, or a bag. These reinforcements of this type can be covered with hardener around the outer surface thereof and filled with hardener by injecting hardener through the body of the reinforcements. Also, the injection of mortar mixed with suitable steel fibre or glass fibre enables a reinforcement with higher tensile strength. The reinforcement will comprise a tubular tension member 2 and an injecting pipe 8 inserted in tension member 2, as shown in FIG. 4(*b*).

(3) Reinforcement with an outer cover having inserted therein tension member, or tension member and injecting means, or injecting means:

The tension member and injecting means employed herein are the same as those described in the above (1). The outer cover may be bar or bag shaped reinforcement with sufficient tensile strength as described in (2), or of a shell having enough compressive strength even without high tensile strength such as those made of concrete material where tension members are inserted in the cover.

This outer cover is disposed on the ground when filling is carried out, and tension members and injecting means may be put in the outer cover before the disposition, or at the time of the disposition, or after the disposition of the cover and the filling. Hardener is filled in the interior of the outer cover at any time after disposition of the cover.

FIG. 4(*c*) illustrates an example of a reinforcement which includes a tubular outer cover 7 of metal and tension members 2 of steel bar or twisted wire. This type of reinforcement is disposed on the ground, and thereafter mortar or the like is injected through injecting means 8.

Figure 5:
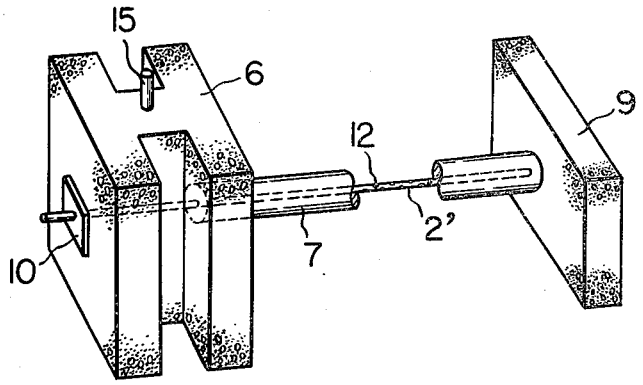
FIG. 5 is a perspective view of a sheathing wall constructed by the present invention.

The reinforcement may be connected to a column member 6 at one end thereof and to an anchor plate 9 at the other end, as shown in FIG. 5. In this connection, 2' denotes a hollow tension member. Cement milk is injected from an end of the tension member, passing therethrough, and fills up the interior of the outer cover 7. Also, one or a plurality of the anchor plates will be secured to an end and/or some portions of the reinforcement, which provides greater drawn-out resistance to the reinforcement.

Solution 3 Embodied by the Invention

This provides a further improved method which is carried out by steps of setting and filling on the ground, materials of reinforcements having an injecting function therein, composed of rigid members and flexible tension members connecting said rigid members, and injecting a hardener into said flexible tension members to harden the same, whereby to dispose rigid structure of the reinforcements in the ground.

This method is based on a combination of the solution 1 with the solution 2 previously described. The tension members having an injecting function employed herein correspond to the flexible reinforcements having an injecting function used in the solution 2, and the rigid members in this method correspond to the rigid members used in the solution 1. Thus this can provide double effects by both the solutions 1 and 2. In particular, this method is excellent in providing an effectively integral constitution to the connecting portions between a wall and reinforcements and between vertical and horizontal reinforcements, to thereby form a more durable structure. Usually, as a wall is formed along a free surface and reinforcements are disposed underground, the further the filling operation is advanced, the greater will be the compression of the filled up soil as well as uneven displacements of soft base ground. This leads to different behaviors between the wall and the reinforcements and thus causes relative displacements therebetween. Then, if the wall and the reinforcements are of an integral rigid structure, stress concentration will be raised at the connection therebetween, which leads to destruction. However, in the method of the invention, because reinforcements include members which are flexible in and after construction until no displacements are caused, they sufficiently accommodate any displacements. And, as the reinforcements finally become rigid by injection of cement milk, they can form stiffened and durable connecting portions with higher resistance against destruction.

Figure 6A:
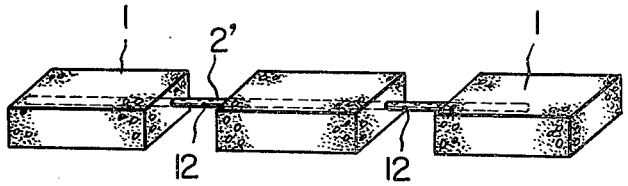
FIG. 6(*a*) is a perspective view of a reinforcement having rigid members and flexible members which have an injecting function, FIG. 6(*b*) being a perspective view of the reinforcement shown in FIG. 6(*a*) with injected hardeners, and FIG. 6(*c*) is also a perspective view of a reinforcement used in the method of the invention.
Figure 6B:
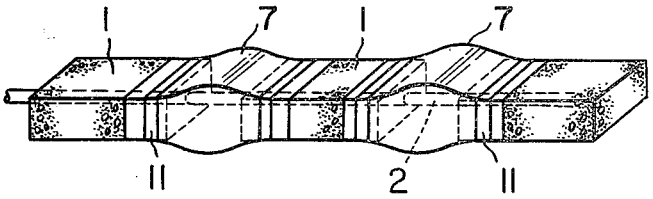
Figure 6C:
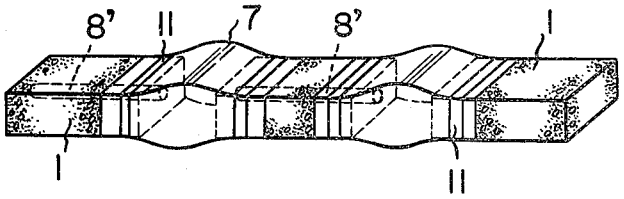

Now referring to FIGS. 6(*a*), 6(*b*) and 6(*c*), there is shown a reinforcement used in the method which includes rigid members 1 and a tension member extending therethrough for connection thereof. This tension member has an injecting function and is provided with injection holes 12, as shown in FIG. 6(*a*) and (*b*). The tension member may be tubular. This method will use any outer covers 7 which are secured to the rigid members preferably by suitable metal fittings 11, as shown in FIG. 6(*b*) and (*c*). Further, in FIG. 6(*c*) an injecting hole 8' is formed in the rigid member 1.

Figure 7A:
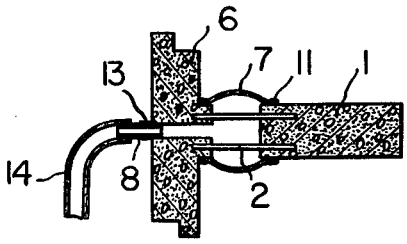
FIG. 7(*a*) and (*b*) are respectively a section and a perspective view of a wall with a reinforcement connected thereto, and FIG. 7(*c*) is a perspective view of a wall with another type of reinforcement connected thereto.
Figure 7B:
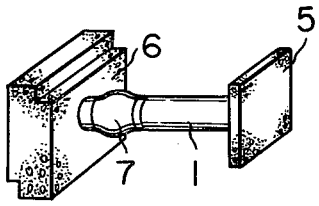
Figure 7C:
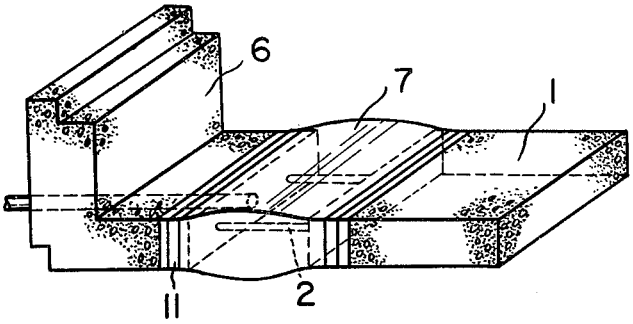
Figure 8A:
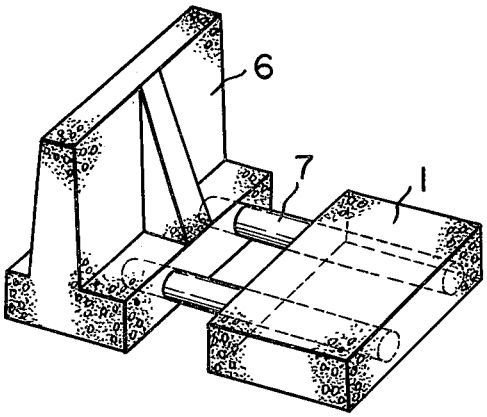
FIG. 8(*a*) is a perspective view of a structure composed of a wall and a reinforcement, FIG. 8(*b*) being a sectional view of the structure shown in FIG. 8(*a*), and FIG. 8(*c*) is a cross-sectional view taken along line A—A in FIG. 8(*b*)
Figure 8B:
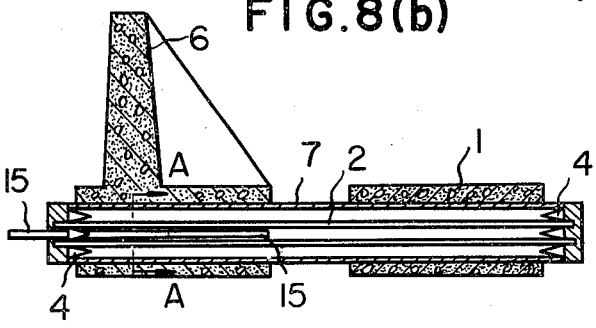
Figure 8C:
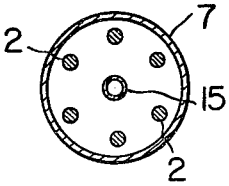
Figure 9A:
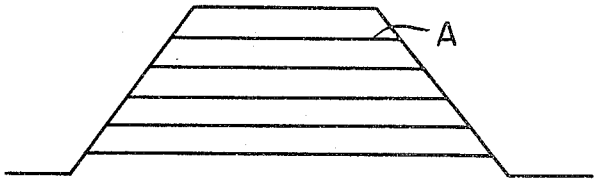
FIG. 9(*a*) – (*g*) are respectively sectional views which schematically show different soil structures constructed by the method of the invention.
Figure 9B:
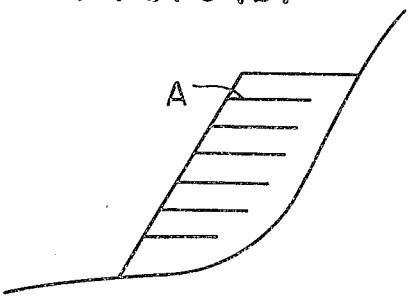
Figure 9C:
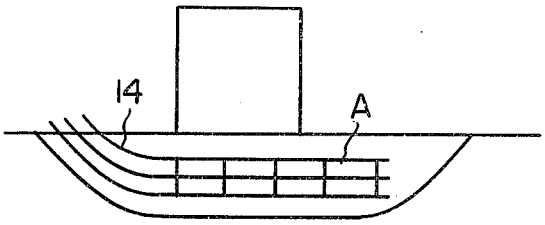
Figure 9D:
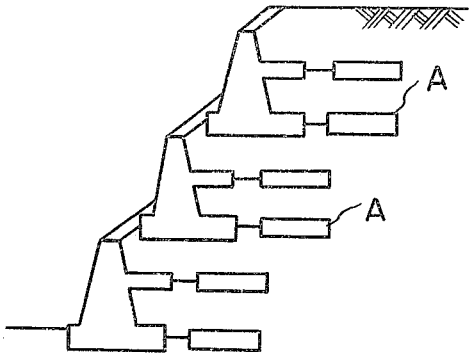
Figure 9E:
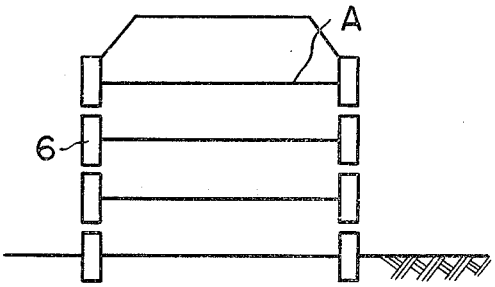
Figure 9F:
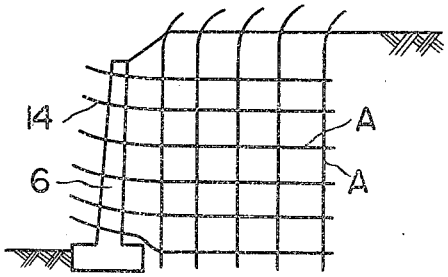
Figure 9G:
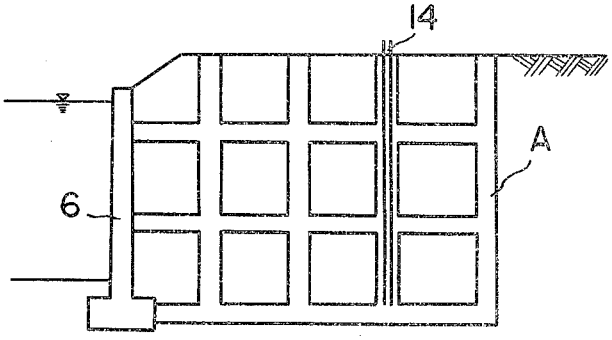

The reinforcements will be connected to a concrete block 6 which forms a wall, as shown in FIG. 7(*a*). In the figure, a cock 13, and an injection hose 14 are provided. FIG. 7(*b*) and (*c*) illustrate respectively similar structures as the one shown in FIG. 7(*a*). The wall may be a L-shaped concrete retaining wall to which outer cover 7 of steel pipe is connected, as shown in FIG. 8(*a*) and (*b*). Tension members 2 extending through the cover as shown in FIG. 8(*b*) may be twisted iron wires or deformed steel bars. These tension members can be under pre-tension. To apply tension on the tension members, the members can be tightened with wedges 4. In FIG. 8(*c*) an injection tube 15 is provided for injecting cement milk or mortar therethrough.

Applications of concrete in the method of the invention will now be described with reference to FIG. 9. Reinforced soil structure may be constructed by disposing reinforcements A in stacked relation in filled up soil, as shown in FIG. 9(*a*) and (*b*). Reinforcements may be assembled cubically in base ground to construct a stiffened soil structure, as shown in FIG. 9(*c*). Injection hoses 14 are provided through which a hardener can be injected at any time. Also, the soil structure constructed by the method of the invention can be applied to roads or sheathing walls in preparing a house site, which structure is shown in FIG. 9(*d*). A fill-up road per se can be also constructed by connecting opposed walls by means of reinforcements A, as shown in FIG. 9(*e*). FIG. 9(*f*) shows another example of sheathing structure in a filled-up construction of a house site or the like. Furthermore, this method can be applied to construction of revetment. An example of the revetment is shown in FIG. 9(*g*). In this case, an assembled structure is previously prepared in which reinforcements A are assembled or connected cubically with wall or wall columns on land. Then, after the structure is mounted in position at the bottom of the water, plate-shaped materials are disposed along the wall columns to form a wall and thereafter sediment is put down for filling. After that, injecting pipes 14 are inserted vertically into the reinforcements to inject hardener and the interior of the reinforcements is filled with the hardener. The injected hardener covers the tension members to improve durability thereof and then sediment around the reinforcements is compressed to greater density thereof. Therefore, mere disposition of the sediment on the water bottom enables enough retention of friction between the reinforcements and the surrounding sediment.

We claim:

1. In a method for constructing a soil structure comprising the step of disposing reinforcements into the ground to thereby reinforce the soil structure by frictional forces between the reinforcements and the soil particles, an improvement wherein the reinforcements are of rigid structure which possess a property of flexibility at least at the time of the disposition of said reinforcements, the frictional forces occurring between said rigid structure and soil particles, to thereby reinforce the soil structure, laying the reinforcements down on the ground and banking soil on the reinforcements, said reinforcements being adapted for injection of material therein and composed of rigid members and flexible tension members connecting said rigid members, injecting a hardener into said flexible tension members to harden the latter members, thereby providing the reinforcements with rigid structure in the ground, said flexible tension members constitute flexible pipes connecting said rigid members, and said pipes having holes thereon for injecting the hardener around said pipes.

2. structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, frictional forces occurring between said rigid structure and soil particles, to thereby reinforce the soil structure, laying the reinforcements down on the ground and banking soil on the reinforcements, said reinforcements being adapted for injection of material therein and composed of rigid members and flexible members connecting said rigid members, injecting a hardener into said flexible members to harden the latter members, thereby providing the reinforcements with rigid structure in the ground, said flexible members constituting flexible pipes connecting said rigid members, and outer covers surrounding said flexible pipes and connecting said rigid members to one another, and said flexible pipes having holes thereon for injecting the hardener into said outer covers.

3. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, the frictional forces developing said rigid structure and soil particles, to thereby reinforce the soil structure, laying the reinforcements down on the ground and banking soil on the reinforcements, said reinforcements being adapted for injection of material thereon and composed of rigid members and flexible tension members connecting said rigid members, injecting a hardener into said flexible tension members to harden the latter members, thereby providing the reinforcements with rigid structure in the ground, said reinforcements further being composed of outer covers connecting said rigid members, said rigid members having holes thereon for injecting a hardener into said outer covers.

4. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at the time of at least the disposition of said reinforcements, the frictional forces developing between said rigid structure and soil particles, to thereby reinforce the soil structure, said method comprising the steps of, laying the reinforcements down on the ground and banking soil on the reinforcements, said reinforcements being adapted for injection of material therein and composed of flexible members, and injecting a hardener into said flexible members to harden said flexible members, thereby providing the reinforcements with rigid structure into the ground, said reinforcements constituting flexible tension members and injecting means, said flexible tension members and said injecting means being disposed such that said injecting means are located within said flexible tension members, respectively.

5. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, said reinforcements consisting of rigid members and flexible tension members connecting said rigid members to each other, with the frictional forces occurring between said rigid members and soil particles, to thereby reinforce the soil structure and to accommodate any displacements of the ground, laying the reinforcements down on the ground and banking soil on the reinforcements, said reinforcements being adapted for injection of material therein, injecting a hardener into said flexible tension members to completely fill inside of the latter members, to completely solidify said inside and to harden the latter members, thereby providing the reinforcements with complete rigid structure in the ground.

6. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, said reinforcements comprising flexible members, thereby to accomodate any displacements of the ground, laying the reinforcements down on the ground and banking soils on the reinforcements, said reinforcements being adapted for injection of material therein, injecting a hardener into said flexible members to completely fill inside of the latter members, to completely solidify said inside and to harden said flexible members, thereby providing the reinforcements with a rigid structure in the ground, the frictional forces occurring between said rigid structure and soil particles, to thereby reinforce the soil structure.

7. In the method claimed in claim 6, wherein said reinforcements constitute flexible tension members and injecting means extending partially through and terminating in said flexible tension members for injecting material into said flexible tension members.

8. In the method claimed in claim 7, wherein said flexible tension members and said injecting means are disposed in parallel to each other.

9. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, said reinforcements consisting of rigid members and flexible tension members connecting said rigid members to each other, with the frictional forces occurring between said rigid members and soil particles, to thereby reinforce the soil structure and to accommodate any displacements of the ground, said rigid members constitute a coplanarly aligned plurality of sets of two parallel spaced slabs each, said flexible tension members extend between said two parallel spaced slabs along the length of said plurality of sets, wedges are connected to ends of said flexible tension members and are wedged between said two parallel spaced slabs at ends of said plurality of sets, and retaining rings are disposed between side surfaces of adjacent coplanarly aligned of said plurality of sets.

10. In a method for constructing a soil structure comprising the step of disposing reinforcements into the ground to thereby reinforce the soil structure by frictional forces between the reinforcements and the soil particles an improvement wherein the reinforcements are of rigid structure which possess a property of flexibility at least at the time of the disposition of said reinforcements, said reinforcements consisting of rigid members and flexible tension members connecting said rigid members to each other, with the frictional forces occurring between said rigid members and soil particles, to thereby reinforce the soil structure and to accommodate any displacements of the ground, said reinforcements each further include a single rigid tubular outer cover extending through said rigid members, a plurality of said flexible tension members are circumferentially and uniformly spaced from each other and longitudinally extend inside of said tubular outer cover, a plurality of wedge means disposed at ends of said tubular outer cover are connected to ends of said flexible tension members for tightening said flexible tension members, said wedge means each constitutes a cone wedged between two adjacent said flexible tension members, and an injection tube extends coaxially into said tubular outer cover centrally inside of said flexible tension members through an end of said outer cover for a length substantially equal to one of said rigid members adjacent thereto, said injection tube having an end defining an opening terminating substantially longitudinally centrally in said tubular outer cover at a point adjacent an end of said one rigid member.

* * * * *

UNITED STATES PATENT AND TRADEMARK OFFICE

CERTIFICATE OF CORRECTION

PATENT NO. : 4,126,001

DATED : November 21, 1978

INVENTOR(S) : Yoshiharu Shimada et al

It is certified that error appears in the above-identified patent and that said Letters Patent are hereby corrected as shown below:

Column 6, line 51 (claim 2) --In a method for constructing a soil-- should be inserted before "structure"

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*